US008925584B2

(12) United States Patent
Balmonet et al.

(10) Patent No.: US 8,925,584 B2
(45) Date of Patent: Jan. 6, 2015

(54) DAMPENED HYDRAULIC PILOT CONTROL ARRANGEMENT FOR A SPOOL VALVE

(75) Inventors: Christian Balmonet, Belley (FR); David Lazzaro, Belley (FR)

(73) Assignee: Renault Trucks, St. Priest (FR)

( * ) Notice: Subject to any disclaimer, the term of this patent is extended or adjusted under 35 U.S.C. 154(b) by 212 days.

(21) Appl. No.: 13/503,412

(22) PCT Filed: Oct. 26, 2009

(86) PCT No.: PCT/IB2009/007563

§ 371 (c)(1),
(2), (4) Date: Apr. 23, 2012

(87) PCT Pub. No.: WO2011/051752

PCT Pub. Date: May 5, 2011

(65) Prior Publication Data

US 2012/0205565 A1 Aug. 16, 2012

(51) Int. Cl.

| | |
|---|---|
| ***F15B 13/04*** | (2006.01) |
| ***F15B 13/042*** | (2006.01) |
| ***F15B 13/043*** | (2006.01) |

(52) U.S. Cl.

CPC ..... *F15B 13/0407* (2013.01); *F15B 13/0426* (2013.01); *F15B 13/0433* (2013.01); *F15B 2211/3111* (2013.01); *F15B 2211/8613* (2013.01)

USPC ..... 137/625.63; 251/54; 91/461; 60/469

(58) Field of Classification Search

CPC .. F15B 13/0407; F15B 13/0422; F15B 1/021; F15B 11/0406; F15B 2211/30505

USPC ..... 137/85, 596.14, 596.15, 625.6, 625.63; 251/31, 48, 54; 91/38, 393, 405, 461; 60/469

See application file for complete search history.

(56) References Cited

U.S. PATENT DOCUMENTS 2,945,478 A * 7/1960 Hanna ..... 91/460
3,042,005 A 7/1962 Gray (Continued)

FOREIGN PATENT DOCUMENTS

DE 2927646 A1 1/1980
DE 2949657 A1 6/1981

OTHER PUBLICATIONS

Machine Translation of DE 2949657, translated Mar. 4, 2014 via ESpacenet translation service, translation attached to original patent copy.*

(Continued)

*Primary Examiner* — Matthew W Jellett
(74) *Attorney, Agent, or Firm* — WRB-IP LLP

(57) ABSTRACT

A hydraulic pilot control arrangement for a spool valve is provided, wherein the spool of the spool valve is biased towards a central position. The arrangement includes a first and a second pilot hydraulic line connected to opposite sides of the spool of the spool valve and a pilot pressure regulating arrangement is provided for selectively establishing or removing a pilot pressure in each of the first and second lines. The arrangement includes a damping device including a chamber divided into a first and a second pressure compartment by a sliding piston, the first and second pressure compartments being connected respectively to the first and second pilot hydraulic lines, and the piston is biased towards a rest position in the chamber.

13 Claims, 2 Drawing Sheets

(56) References Cited

U.S. PATENT DOCUMENTS

| | | | | | |
|---|---|---|---|---|---|
| 3,046,951 | A | * | 7/1962 | Freeborn | 137/625.63 |
| 3,872,876 | A | * | 3/1975 | Bachmann | 137/118.01 |
| 4,753,158 | A | * | 6/1988 | Hirata et al. | 91/461 |
| 4,858,649 | A | * | 8/1989 | Satoh et al. | 137/625.6 |
| 5,760,358 | A | * | 6/1998 | Plettner | 218/154 |

OTHER PUBLICATIONS

International Search Report for corresponding international Application PCT/IB2009/007563.

JP 200I 208005 A (Hitachi Construction Machinery) Aug. 3, 2001 * abstract; figure 1.

* cited by examiner

DAMPENED HYDRAULIC PILOT CONTROL ARRANGEMENT FOR A SPOOL VALVE

BACKGROUND AND SUMMARY

The invention relates to the field of hydraulic pilot control arrangements for piloting a spool valve.

Spool valves are for example used for controlling the flow and direction of hydraulic fluid sent to an actuator. In some cases, for example when a spool valve is used in a high pressure power hydraulic circuit, its spool is not directly controlled mechanically or electrically, but it is preferably piloted hydraulically through a hydraulic pilot circuit. In a hydraulically piloted spool valve, the movements of the spool are due to the application of a pilot hydraulic pressure on the spool, thereby modifying the position of the spool with respect to a body of the valve and thereby changing the flow of the high pressure hydraulic fluid through the valve. Generally, the pilot pressure is lower than the high pressure of the power circuit. In some cases, the hydraulic pilot circuit comprises a first and a second pilot hydraulic lines connected to opposite sides of the spool of the spool valve, and comprises pilot pressure regulating means for selectively establishing or removing a pilot pressure in each of said first and second pressure lines. In most cases, it is provided that pilot pressure can be sent to only one side of the spool at a time. The spool valve can be biased towards a central position where it returns when no pilot pressure in sent on either side of the spool. The pilot pressure regulating means are for example in the form of joystick-type hydraulic controller.

One known problem of such type of pilot control arrangements is that, when pilot pressure is established in one pilot line by the pressure regulating means, the pressure establishment in that line can be quite sudden, which results in a sudden movement of the spool, which will in turn into a quite sudden application of pressure to the power actuator fed through the spool valve. This results in a quite brutal starting movement of the actuator, which is in most cases not desirable. The same effects can be seen when pilot pressure is removed from a corresponding pilot line: sudden movement of the spool, and therefore sudden stop of actuator are inevitable.

To limit the sudden stop and start movements of the actuator, it is known to arrange flow limiters in the hydraulic pilot lines for limiting the flow of hydraulic fluid from the spool to the pilot pressure regulating means and inversely. Those flow limiters therefore slow down the movement of the spool when it leaves or goes back to its central position, and thereby dampen the stopping movement. Flow limiters can be arranged as fixed throttles in the pilot lines. But, in some cases, these fixed throttles need to be of a very small diameter to be effective, and they then present the risk of getting suddenly clogged by some impurities contained in the hydraulic fluid. Upon starting, such clogging would simply translate in the actuator not moving, which is already a problem. But when it comes to stopping, the clogging would translate in the actuator not stopping its movement which can have very severe consequences.

Therefore, there is a need to design a new hydraulic pilot pressure arrangement which may dampen the start and stop movements of the actuator, without having the risks of clogging known with the currently used damping technologies.

The invention relates, according to an aspect thereof, to a hydraulic pilot control arrangement for a spool valve, wherein the spool of the spool valve is biased towards a central position, wherein the arrangement comprises a first and a second pilot hydraulic line connected to opposite sides of the spool of the spool valve and wherein pilot pressure regulating means are provided for selectively establishing or removing a pilot pressure in each of said first and second pressure lines, characterized in that the arrangement comprises a damping device including a chamber divided into a first and a second pressure compartment by a sliding piston, the first and second pressure compartments being connected respectively to the first and second pilot hydraulic lines, and said piston being biased towards a rest position in the chamber.

DETAILED DESCRIPTION

Figure 1:
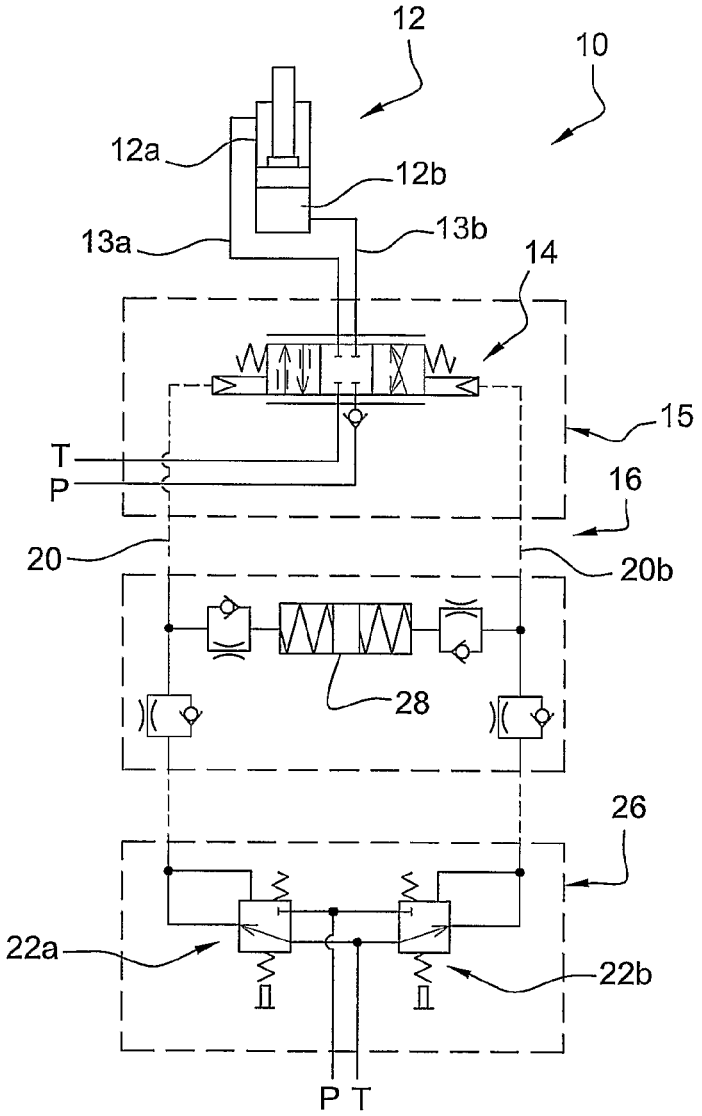
FIG. 1 is a schematic diagram of a simplified hydraulic circuit for controlling an actuator through a spool valve, said circuit comprising a hydraulic pilot control arrangement according to the invention.

On FIG. 1 is represented a hydraulic circuit 10 for controlling an actuator 12. The actuator is here represented as two-way cylinder, but it could be any kind of actuator, such as a hydraulic motor. The actuator 12 has two working chambers 12*a*, 12*b* so that it may be controlled to move in a first direction or in a second direction, depending on whether pressurized fluid is provided to one or the other of said chambers. Such first and second directions of movement of the actuator can be arbitrarily called forwards and reverse. A proportional directional valve 14 is provided for controlling to which of said chambers pressurized fluid is sent. The valve 14 is for example a valve having 4 ports, connected respectively to a pressure source line P, for example a pump, to a tank line T or a sump, and, through two power lines 13*a*, 13*b*, to the two working chambers 12*a*, 12*b* of the actuator. The valve is for example a spool valve where the spool has three main positions: two extreme positions where one of the chambers 12*a*, 12*b* is connected to the pressurized source of fluid P while the other chamber 12*b*, 12*a* is connected to the tank T, and a central position or neutral position where, for example, all ports are closed. The valve 14 has its spool which is biased towards its central position for example by two springs acting on each side of the spool. By central, it is here meant a position between the two extreme positions, and not necessarily a position exactly at mid distance between those two extreme positions. Being a proportional valve, the intermediate positions between the central position and the extreme positions correspond to more or less restricted communication between the working chambers on the one side and the pressurized source and the tank on the other side. The valve can be part of a valve block 15 which may comprise other directional control valves and/or other hydraulic components, such as for regulating the pressure in the power lines 13*a*, 13*b*, and/or in the pressure source line P. The pressure line P, the tank line T, the power lines 13*a*, 13*b* and the working chambers 12*a*, 12*b* are therefore part of a power circuit in which the quantity and direction of flow of pressurized fluid is controlled by valve 14. When the spool is on one side of its central position, it controls a forward movement of the actuator, and when it is on the other side, it controls a reverse movement of the actuator.

The valve 14 is hydraulically piloted, and the hydraulic circuit comprises therefore a hydraulic pilot control arrangement 16. The pilot arrangement 16 comprises a first hydraulic pilot pressure line 20*a* and a second hydraulic pilot pressure line 20*b* which are hydraulically connected each on one side of the valve 14 so that, when the first pilot line 20*a* conveys pressurized pilot fluid, the valve spool is forced in a first direction towards a first extreme position, and when the second pilot 20*b* line conveys pressurized pilot fluid, the valve spool is forced in a second direction towards a second extreme position. The pressure in each pilot line is controlled through a dedicated proportional pilot valve 22*a*, 22*b*. In other words, the pilot valves 22, 22*b* are pilot pressure regulating means which selectively connect the first and second hydraulic pilot pressure lines to a source of pilot pressure or to a sump. In a customary fashion, the two pilot valves are part of a joystick controller 26 whereby a user can control both pilot valves through one single actuating member. Nevertheless, each pilot valve could be equipped with is own actuating member. Each pilot valve is connected both to a source of pilot pressurized fluid and to a tank or a sump. Depending on the action of the user on the joystick controller, one or the other pilot valves 22*a*, 22*b* sets a proportional pilot pressure in the corresponding pilot line 22*a*, 22*b*, while the other line is connected to the tank or the sump. The pilot valves are usually biased towards a rest position where the pilot lines are connected to the sump. Typically, the maximum pressure in the pilot circuit would be in the order of 5-50 bars while the maximum pressure in the power lines would be in the order of 600-300 bars. Therefore, depending on the pressure in the pilot lines, the spool of valve 14 will be forced towards one or the other of its extreme positions, and, when both pilot lines are connected to the tank because the joystick controller is released to a rest position, the spool of the valve 14 is forced back to its central position.

The pilot circuit arrangement 16 also comprises a damping device 28. As can be seen on FIG. 2, the damping device 28 includes a chamber 30 divided into a first and a second pressure compartment 30*a*, 30*b* by a sliding piston 32. The compartments 30*a*, 30*b* are fluidically sealed one from the other by the piston 32, and depending on the position of the piston, they exhibit a variable volume. The first and second pressure compartments 30*a*, 30*b* are connected respectively to the first and second pilot hydraulic lines 20*a*, 20*b*. In the embodiment shown, this connection is made by a respective conduit 31*a*, 31*b*. The position of the piston 32 in the chamber 30 is therefore dependent on the relative pressures in both compartments 30*a*, 30*b*. The piston 32 is biased towards a rest position in the chamber 30 which corresponds to the position of the piston in absence of pressure in both compartments.

Figure 2:
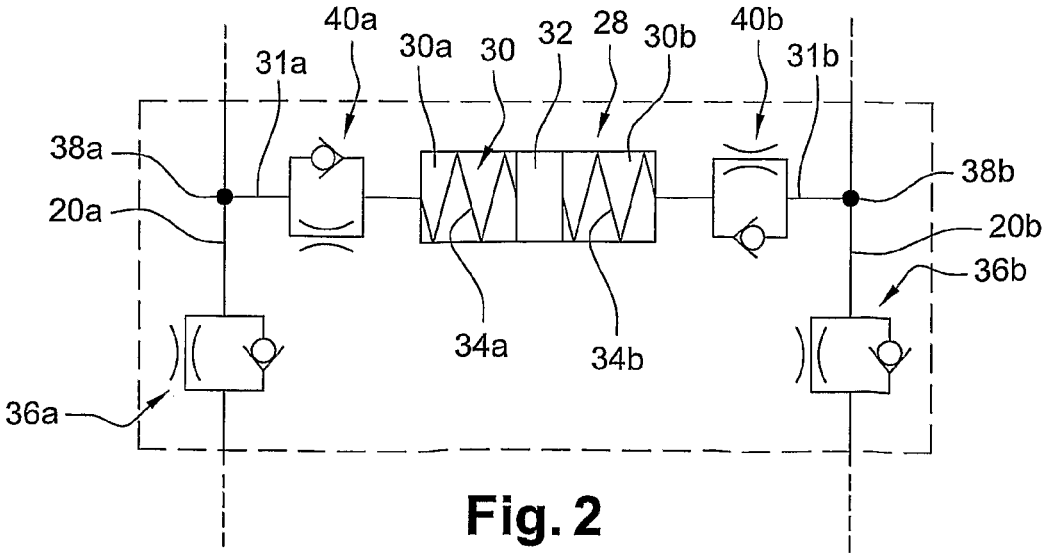
FIG. 2 is a more detailed view of the diagram of FIG. 2 where only a damping device and associated optional unidirectional flow restrictions are represented.

In the first embodiment shown on FIGS. 1 and 2, the piston 32 is biased towards a median position in the chamber. For example this can be achieved through two opposing biasing members 34*a*, 34*b*, which can be in the form of springs. The force exerted by the biasing means determines the exact location of the piston 32 when no pressure is maintained in the first and second pressure compartments.

The dampening device thereby forms, for each pilot line, an expandable volume which will increase when pressurized fluid is sent in the respective pilot line 20*a*, 20*b* by the respective pilot valves 22*a*, 22*b*. The fact that this volume increases will inevitably tend to decrease the speed at which the spool of valve 14 is displaced from its central position to an extreme position when the pilot valves are suddenly controlled to send full pilot pressure in one of the pilot line. Indeed, the volume of pilot fluid necessary for filling the expanding volume of the pressure compartment 30*a*, 30*b*, will not be available to generate a displacement of the spool of valve 14. Therefore, the starting movement of the actuator will be dampened.

The arrangement further comprises two primary unidirectional flow limiters 36*a*, 36*b* which are respectively arranged in the first and second hydraulic pilot lines 20*a*, 20*b*. The primary flow limiters 36*a*, 36*b* limit the flow of hydraulic fluid in the corresponding pilot line, but only in one direction: from the spool of valve 14 to the pilot pressure regulating means, i.e. the pilot valves 22*a*, 22*b*. Such flow corresponds to a stopping of the movement of the actuator, whatever the direction of its movement. The flow of pressurized fluid in the opposite direction is substantially unhindered. Preferably, the primary unidirectional flow limiters 36*a*, 36*b* are arranged between the connection 38*a*, 38*b* of the respective pressure compartment 30*a*, 30*b* to the respective pilot hydraulic line 20*a*, 20*b*, and the respective pilot valve 22*a*, 22*b*. As shown on the Figures, each unidirectional flow limiter 36*a*, 36*b* can comprise a check valve hydraulically in parallel with a throttle, both being installed on the pilot line. In such a case, the throttle can be fixed, or adjustable.

One important function of the primary unidirectional flow limiters 36*a*, 36*b* is to dampen the return movement of the spool when the controller is suddenly brought from an extreme position to its rest position, which corresponds to a damping effect on the stopping of the movement of the actuator. Indeed, by limiting the flow out of the previously pressurized pilot line, the volume of fluid which was contained in the pilot line needs to go through the flow limiter, and it takes a certain time to achieve this. Indeed, the volume of fluid corresponds not only to the static volume of the pilot line in itself, but also to the variable volume displaced by the spool of valve 14 and, more importantly, to the volume displaced by the piston 32 of the damping device between an extreme position and its rest position. Therefore, the displacement volume of the piston 32 is here added to the preceding volumes, increasing the total volume of hydraulic fluid which has to go through the flow limiter. As long as this additional volume of fluid has not passed through the flow limiter 36*a*, 36*b*, there remains a counter-pressure in the pilot line which tends to slow down the movement of the spool of valve 14. This additional counter-pressure is the result of the action of the springs on the piston, but also, if a pilot pressure has been set in the other pilot line, of the action of that pilot pressure in the opposite compartment on the piston.

Preferably, the hydraulic pilot control arrangement is dimensioned in such a way that the time of displacement of the piston 32 from an extreme position to its rest position is in the same order of magnitude as the time of displacement of the spool of valve 14 from an extreme position to its central position. Indeed, it must be noted that the spool and the piston 32 are subject to substantially the same pressures on each of their sides, but the corresponding forces are influenced by the respective active surfaces of the spool and of the piston on which these pressures act. Also, both the spool and the piston are subject to biasing means, which may have different characteristics, and they may also have a different displacement length from their extreme positions to their respective central and rest positions. Nevertheless, the time it takes for the piston to go from its extreme position to its rest position corresponds to the time where it will be effective in its dampening action for the spool. Therefore it is preferable to adjust this time to the time needed for the spool to go back to its central position. The relative timings will be in the same order of magnitude if the supplementary damping effect obtained thanks to the piston displacement extends over a period of time during which there is a decrease in the flow controlled by the valve 14 in the order of at least, for example, one fourth, one half or two thirds. For example, if the flow controlled through the valve 14 is substantially linear with the displacement of the spool, the time of displacement of the piston 32 from an extreme position to its rest position should be at least one fourth, or one half or two thirds of the time of displacement of the spool of valve 14 from an extreme position to its central position. Of course, it can be chosen to have both times substantially equal so that the supplementary damping effect obtained thanks to the piston displacement extends over substantially all the time for the spool to come back to its central position. Of course, it is possible to act on many parameters to adjust those timings, but, for a given spool valve 14, for given pilot hydraulic line 20*a*, 20*b*, and for a given displacement volume of the piston 32, the choice of the biasing elements 34*a*, 34*b* and of the section of the throttle in the unidirectional flow limiters 36*a*, 36*b* are important factors for setting the relative displacement timing of the spool and of the piston.

Preferably, the primary unidirectional flow limiters 34*a*, 36*b* do not substantially slow down the flow of oil from the pilot valves 22*a*, 22*b* to the spool of valve 14.

According to an enhanced embodiment of the invention, the first and second pressure compartments 30*a*, 30*b* are connected respectively to the first and second pilot hydraulic lines through secondary unidirectional flow limiters 40*a*, 40*b* for limiting the flow of hydraulic fluid from the first and second hydraulic pilot lines to the first and second pressure compartments. The secondary unidirectional flow limiters may be arranged in the connection conduits 31*a*, 31*b*. Each unidirectional flow limiter 40*a*, 40*b* can comprise a check valve hydraulically in parallel with a throttle, both being installed on the connection conduit. In such a case, the throttle can be fixed, or adjustable. The secondary unidirectional flow limiters, which are optional, will impact mainly the damping of the starting movement of the actuator.

Similarly to what has been described above, the hydraulic pilot control arrangement is preferably dimensioned in such a way that the time of displacement of the piston from its rest position to an extreme position is in the same order of magnitude as the time of displacement of the spool from its central position to an extreme position. As above, the dimensioning of the biasing members 34*a*, 34*b* and of the secondary unidirectional flow limiters are for example the parameters on which it is possible to act to achieve this. It must be noted that the damping effect for the displacement of the spool from its central position to an extreme position can be set differently than the damping effect for the displacement of the spool from an extreme position to its central position. In other words, the damping effect can be different at the starting of the actuator than the damping effect at the stopping of the actuator. This can be referred to as the start/stop damping symmetry or dissymmetry of the pilot arrangement.

The embodiment of the invention described above in relation to the FIGS. 1 and 2 may be symmetric with respect to the actuator movement position in as much as the damping effect of the damping device is active for both travel directions of the actuator. In such a case, the two biasing members 34*a*, 34*b* may for example have similar settings. Similarly, the two primary unidirectional flow limiters 36*a*, 36*b*, and/or the two secondary unidirectional flow limiters 40*a*, 40*b* respectively may also have similar settings. Nevertheless, it could be designed to have a dissymmetric behavior, simply by having different settings for the two biasing members, and/or for the two primary unidirectional flow limiters, and/or for the two secondary unidirectional flow limiters. According to a further possible design, only one of the two secondary flow limiters 40*a*, 40*b* is provided. In such cases, the damping effect would be different depending upon the direction of movement of the actuator. This can be referred to as the forward/reverse damping symmetry or dissymmetry of the pilot arrangement.

Figure 3:
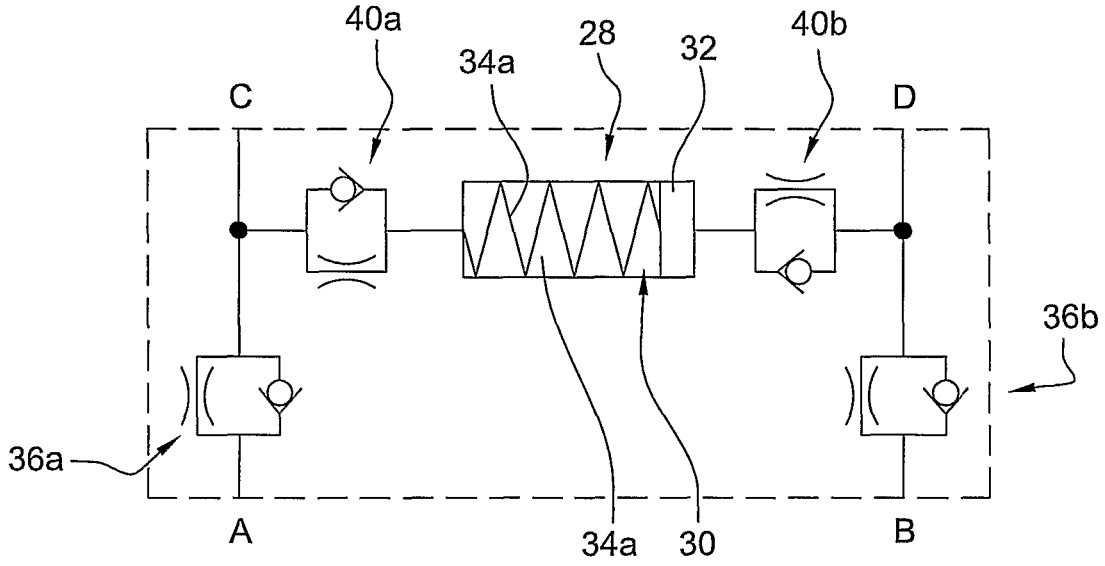
FIG. 3 is a view similar to that of FIG. 2, showing a variant of the invention.

FIG. 3 illustrates a second embodiment of the invention which can be seen as a pilot arrangement having an extreme forward/reverse damping dissymmetry. Indeed, it can be seen that the piston 32 of the damping device 28 is subject to only one biasing member, and in that the piston can move only to one side of the rest position to which it is biased. The damping device 28 is otherwise similar to the one described above. The rest position can for example be set such that the first pressure compartment 30*a* then represents the major portion of the volume of the chamber 30, while the volume of the second pressure compartment 30*b* is then null or almost null. Therefore, the damping effect due to the relative movement of the piston 32 will only be available for the second pilot line, i.e. for only one direction of movement of the actuator, either forward or reverse.

Thanks to the invention, it is possible to achieve an appropriate damping effect without using too restrictive primary flow limiters 36*a*, 36*b*. For example, flow limiters 36*a*, 36*b* can comprise throttles having a cross section greater than 0.2 square millimeters (corresponding to a 0.5 mm diameter circular cross section). The settings of the components may for example be chosen so as to obtain a damping effect spreading over a period of time ranging from 0.1 to 1 second.

The damping device 28 and the secondary unidirectional flow limiters 40*a*, 40*b* can be integrated into one single component block, and, as shown on the Figures, such a block can also include the primary unidirectional flow limiters 36*a*, 36*b*. These components can also be separate components.

The invention claimed is:

1. Hydraulic pilot control arrangement for a spool valve, wherein the spool of the spool valve is biased towards a central position, wherein the arrangement comprises a first and a second pilot hydraulic line connected to opposite sides of the spool of the spool valve, pilot pressure regulating means for selectively establishing or removing a pilot pressure in each of the first and second pilot hydraulic lines, a damping device including, a chamber divided into a first and a second pressure compartment by a sliding piston, the first and second pressure compartments being connected respectively to the first and second pilot hydraulic lines, and the piston being biased towards a rest position in the chamber, wherein at least one of the first and second pressure compartments is connected respectively to the first and second pilot hydraulic lines through a secondary unidirectional flow limiter for limiting the flow of hydraulic fluid from the first and/or second hydraulic pilot line to the first and/or second pressure compartment.

2. Hydraulic pilot control arrangement according to claim 1, wherein the rest position of the piston is as median position.

3. Hydraulic pilot control arrangement according to claim 2, wherein the piston is biased towards its median position in the chamber by two opposing, biasing members.

4. Hydraulic pilot control arrangement according, to claim 1, wherein the arrangement further comprises two primary unidirectional flow limiters respectively arranged in the first and second hydraulic pilot lines for limiting the flow of hydraulic fluid from the spool to the pilot pressure regulating means, and the primary unidirectional flow limiters are arranged between a connection of the respective pressure compartment to the respective pilot hydraulic line and the pressure regulating means.

5. Hydraulic pilot control arrangement according to claim 1, wherein the arrangement is dimensioned in such a way that the time of displacement of the piston from its rest position to an extreme position is in the same order of magnitude as the time of displacement of the spool of the spool valve from its central position to an extreme position.

6. Hydraulic pilot control arrangement according to claim 1, wherein the arrangement is dimensioned in such a way that the time of displacement of the piston from an extreme position to its rest position is in the same order of magnitude as the time of displacement of the spool of the spool valve from an extreme position to its central position.

7. Hydraulic pilot control arrangement according to claim 3, wherein a unidirectional flow limiter composes a check valve hydraulically in parallel with a throttle.

8. Hydraulic pilot control arrangement according, to claim 1, characterized that the pilot pressure regulating means selectively connect the first and second hydraulic pressure lines to a source of pilot pressure or to a sump.

9. Hydraulic pilot control arrangement according to claim 1, wherein the pilot pressure regulating means are in the form of two proportional valves.

10. Hydraulic pilot control arrangement according to claim 8, wherein the two proportional valves are controllable through a joystick.

11. Hydraulic pilot control arrangement according to claim 1, wherein the spool valve is a proportional directional valve in a hydraulic power circuit.

12. A hydraulic circuit, comprising:

an actuator;

a pressure source line connected to a source of pressurized fluid;

a tank line connected to a tank;

a hydraulic pilot control arrangement for a spool valve, the spool valve being connected fluidically series between the actuator on one side and the pressure source line and the tank line on another side, the spool valve being adapted to selectively direct or prevent flow from the pressure source line to the actuator and from the actuator to the tank line through the spool valve, wherein the arrangement comprises a first and a second pilot hydraulic line connected to opposite sides of the spool of the spool valve, pilot pressure regulating means for selectively establishing or removing a pilot pressure in each of the first and second pilot hydraulic lines, a damping device including a chamber divided into a first and a second pressure compartment by a sliding piston, the first and second pressure compartments being connected respectively to the first and second pilot hydraulic lines, and the piston being biased towards a rest position in the chamber.

13. Hydraulic pilot control arrangement according to claim 12, wherein the piston is biased towards the rest position in the chamber in a central position in the chamber by biasing means on opposite sides of the piston.

* * * * *

UNITED STATES PATENT AND TRADEMARK OFFICE

CERTIFICATE OF CORRECTION

PATENT NO. : 8,925,584 B2
APPLICATION NO. : 13/503412
DATED : January 6, 2015
INVENTOR(S) : Christian Balmonet et al.

It is certified that error appears in the above-identified patent and that said Letters Patent is hereby corrected as shown below:

On The Title Page, item (73)

Change name of Assignee from "Renault Trucks, St. Priest (FR)" to --Volvo Compact Equipment SAS, Belley (FR)--.

Signed and Sealed this
Twentieth Day of October, 2015

Michelle K. Lee

Michelle K. Lee
*Director of the United States Patent and Trademark Office*